United States Patent [19]

Berg

[11] 4,256,919

[45] Mar. 17, 1981

[54] TEMPERATURE CONFINING DEVICES AND METHOD

[75] Inventor: Charles A. Berg, Buckfield, Me.

[73] Assignee: Pyreflex Corp., Buckfield, Me.

[21] Appl. No.: 10,712

[22] Filed: Feb. 9, 1979

Related U.S. Application Data

[63] Continuation-in-part of Ser. No. 898,289, Apr. 20, 1978, abandoned, and a continuation-in-part of Ser. No. 934,025, Aug. 16, 1978, abandoned.

[51] Int. Cl.[3] ..... F27D 11/04; F27D 11/06; F27D 9/00

[52] U.S. Cl. ..... 13/23; 13/26; 13/31 R; 219/162; 164/122; 165/61

[58] Field of Search ..... 13/26, 27, 1, 5, 23, 13/31; 165/61; 164/122; 219/10.41, 10.49 R, 10.57, 10.67, 10.75, 10.79, 85 BM, 85 CM, 50, 162

[56] References Cited

U.S. PATENT DOCUMENTS

| | | | |
|---|---|---|---|
| 2,848,566 | 8/1958 | Limpel | 219/10.49 |
| 3,095,494 | 6/1963 | Denton et al. | 13/31 X |
| 3,124,634 | 3/1964 | Westeren et al. | 13/31 |
| 3,185,460 | 5/1965 | Mescher et al. | 13/31 X |
| 3,350,494 | 10/1967 | Kunitsky et al. | 13/27 |
| 3,470,624 | 10/1969 | Plotkowiak | 165/61 X |
| 3,626,154 | 12/1971 | Reed . | |

*Primary Examiner*—Roy N. Envall, Jr.

[57] ABSTRACT

Energy efficient reheating furnaces and soaking pits having essentially zero thermal inertia are disclosed.

The furnace comprises an evacuate chamber having a workpiece support, an envelope having a highly infrared reflective interior surface bounding the chamber, and a workpiece heating means comprising electric leads and contacts for heating the workpiece by electrical resistance and/or a cryogenically cooled induction coil located outside of the envelope for heating the workpiece by eddy current dissipation. A workpiece on the support is thermally isolated since convective heat losses are eliminated, conductive heat losses minimized, and radiative heat losses limited to about 10 percent or less of the workpiece's black body radiative flux. Since radiation emitted by the workpiece does not reach the induction coil, the design allows the application of cryogenic-superconductivity technology which eliminates eddy current losses in the coil. The furnace is characterized by dramatic increases in energy efficiency and decreases in material losses by scaling.

The soaking pit comprises an evacuated enclosure having a workpiece support, an infrared-reflective envelope, and electric leads for passing alternating current through a workpiece located on the support. A hot, radiating ingot, when placed in the soaking pit, can be cooled at a controlled rate because essentially its only mechanism of heat loss is by emission of radiation, and the net radiative loss can be adjusted by passing a current through the ingot or reflecting a fraction of the emitted radiation back to the ingot, the remainder being absorbed into the envelope or other structure in the soaking pit.

42 Claims, 4 Drawing Figures

TEMPERATURE CONFINING DEVICES AND METHOD

REFERENCE TO RELATED APPLICATIONS

This application is a continuation-in-part of copending applications Ser. Nos. 898,289, filed Apr. 20, 1978 abandoned and 934,025, abandoned, filed Aug. 16, 1978, the disclosures of which are incorporated herein by reference.

BACKGROUND OF THE INVENTION

This invention relates to an improved energy efficient method of heating and cooling cast metal structures such as ingots and slabs, and to devices suitable for practicing the method.

When an ingot is cast from molten metal, it is first allowed to cool in the mold to a state wherein its outer skin is solid and its interior is very soft or liquid. The mold is then stripped away, and the ingot is placed in a specialized furnace known in the art as a "soaking pit" where it is allowed to cool slowly until it solidifies throughout. Slow cooling is accomplished by subjecting the ingot to the vitiated combustion products of high quality fossil fuels.

Although soaking pits are used to carry out a process of controlled cooling, they are one of the largest consumers of fuel in the steel making industry. Moreover, because of the temperature that must be maintained in the soaking it (on the order of 2200° F. to 2350° F.), the metal being treated is subject to oxidation and chemical attack from stray impurities in the fuel such as sulfur. For this reason, natural gas, low sulfur distillate oil, or some other fuel of equivalent purity must be employed. The fuel consumption of a soaking pit ranges from about $0.5\times10^6$ BTU to about $3.0\times10^6$ BTU per ton of material processed. Given that the steel industry in the U.S.A. produces about $150\times10^6$ tons of steel per year, and that nearly all of this production goes through soaking pits, the annual consumption of fuel for the controlled cooling of steel ingots is equivalent to approximately 363 billion cubic feet of natural gas, or about 2% of the total domestic annual natural gas consumption.

Even though fuel of high chemical purity is used in soaking pits, and despite the control exerted over the combustion process, oxidation of the steel being processed proceeds so rapidly that approximately 4% of its mass is lost as scale during treatment in the soaking pit furnace. Obviously, this alone has serious economic implications for steel making. The composite price of finished steel products is currently about 18 cents per pound or $360.00 per ton. Thus, the loss of material in the soaking pits represents a loss of approximately $5.00 per ton of product. The cost of fuel used to maintain the temperature of the soaking pits also represents about $5.00 per ton. To put these expenses in perspective, it should be noted that the value of the fuel used and of the scale loss is comparable with the profit per ton of finished product reported by several domestic steel companies.

In the subsequent processing of steels and other metals, it is often necessary to heat the metal prior to subjecting it to rolling, forging, annealing, or other hot forming process. For example, in many steel mills, steel slabs weighing on the order of 100 tons each are heated from about 70° F. to 2350° F. prior to undergoing a rolling process. This step is known in the metal processing art as "reheating".

The most widely used reheating apparatus is the combustion furnace wherein the material treated is exposed directly to the flame of the fuel employed. Heat is transferred to the material by direct convection from the combustion products, by radiation from the flames, and by radiation from the ceramic material which lines the furnace. In order to obtain a reasonable level of efficiency, all such furnaces must be equipped with heat recuperation equipment which typically represents as much as two-thirds of their total capital cost. Typically, the recuperator system comprises a gas-to-gas heat exchanger which is notoriously subject of fouling.

These combustion reheating furnaces suffer from a number of disadvantages, perhaps the most serious of which is their low energy efficiency. In this regard, one of the most advanced designs presently available is said to be capable of reheating 300 tons of steel per hour from 70° to 2350° F., at a fuel cost of about $10^9$ BTU. Given that the specific heat of steel is about 0.11 BTU/lb/°F., the heat stored in the steel is approximately $1.505\times10^8$ BTU. Thus, the heat transfer efficiency of this rather advanced version of a combustion reheating furnace is only on the order of 25%.

Another disadvantage of combustion reheating furnaces is their inability to be quickly turned on and off, sometimes referred to as their high "thermal inertia". This property results from the inability of the refractory ceramic liners to be heated and cooled rapidly without undergoing serious damage. Thus, in many operations (e.g., stainless steel production) a combustion reheating furnace is in practice energized 24 hours a day, even though it may be used only 40 hours per week. This of course represents a very large burden on operating costs and gives rise to severe maintenance problems.

As in the soaking pit furnaces, another drawback of combustion reheating furnaces results from the need to control the atmosphere within the furnace itself to minimize chemical damage to the material being processed. This necessitates the use of fuels of very high chemical purity such as natural gas, propane, and low sulfur distillate oils. If high sulfur bearing fuels are used, a sulfide scale forms on the stock. Use of a fuel high in alkali ash leads to chemical damage to the stock. Even when using the relatively pure fuels mentioned above, the formation of oxide scale amounts to a considerable material loss and creates an environmental pollutant which must be dealt with. Thus, about 4% of all material passing through a stainless steel production mill is lost as oxide scale in the reheating furnace. Furthermore, scale often causes accelerated wear in forming equipment such as forging dies.

It should be appreciated that there is no significant opportunity to employ the direct combustion of coal in either reheating furnaces or soaking pits since at the combustion temperatures required, the ash of most domestic coals softens and clings to heat transfer surfaces like a paste, thereby rapidly fouling heat exchange surfaces. Also, the alkali ash in the coal can induce adverse chemical effects on the workstock.

Because of the foregoing disadvantages, and with the increasing cost of chemically pure fuels, it has now become attractive to employ electric furnaces for reheating purposes, and in fact, some recently constructed steel plants already employ electric induction reheating. These furnaces offer several advantages, such as enabling the use of coal as a primary fuel (to generate electricity) and providing flexibility in the control of the atmosphere surrounding the workpiece.

In the furnace of these plants, the stock is surrounded by a coil of copper bars which, when energized with AC power, induces eddy currents in the stock itself, resulting in heating by eddy current dissipation. As stock temperature rises, the stock radiates heat to the walls of the furnace which typically consist of the induction coil itself shielded by a thin refractory ceramic plate on the order of one inch thick. As the coil is heated by radiation from the stock and ceramic plate, its resistivity increases and the eddy current losses in the coil become significant. Water is circulated through the coils to prevent them from overheating. Although only somewhat less than half of the electrical energy supplied to the coil is actually transferred to the workstock as heat, the net fuel use efficiency in such electro-induction reheating furnaces is comparable to the most efficient combustion furnaces. Also, the electro-induction furnace can be turned on or off quite rapidly, thereby offering important advantages in flexibility of operation and ease of maintenance. However, currently employed electro-induction furnaces heat the workpiece in an environment of air rather than nearly vitiated combustion products, and scale production takes place rather rapidly. In fact, the production of oxide scale in such furnaces is so rapid that the workstock often undergoes "spalling", a phenomenon wherein flakes of scale are expelled from the surface of the workpiece with such force that they become embedded in the refractory sheath that protects the induction coils.

A typical electro-induction reheating furnace for processing 100 tons of steel per hour has an average power demand on the order of 30 to 31 megawatts. Energy flux into the unit is therefor about $1.05\times10^8$ BTU per hour. To heat 100 tons of steel from 70° F. to 2350° F. required $5.016\times10^7$ BTU. Accordingly, the efficiency of energy transfer to the workpiece in such a furnace is approximately 48%. To put the economics in perspective, it should be noted that the capital costs of a furnace of this type are about 1.5 million dollars. To build the electric generating capacity required to energize the furnace, at its peak load of 35 megawatts, costs approximately 36.4 million dollars. Accordingly, improvements in efficiency in the conversion of electrical energy to heat in the workstock would be economically attractive.

SUMMARY OF THE INVENTION

The invention provides an energy efficient apparatus for varying the temperature of a metallic workpiece. Broadly, the apparatus comprises a housing which includes a vacuum seal, a workpiece support disposed within the housing, means for evacuating the interior of the housing, an infrared reflective envelope within the housing located to reflect radiation emitted from a hot workpiece back thereto, and means for heating the workpiece. The envelope has an infrared reflective surface, preferably a specular reflective surface, and includes means for dissipating heat such as a corrugated structure having a plurality of passageways through which cooling fluids flow. Optionally, the apparatus also comprises a thin, lightweight shield of high emissivity material which protects the reflective envelope from matter which may be ejected by a workpiece on the support. In this circumstance, the means for evacuating the housing preferably includes a port which communicates with the space between the workpiece and the shield.

In one embodiment, the invention comprises an improved soaking pit. A workpiece such as a steel ingot is placed on the support and the interior of the housing is evacuated. Because of the low pressure environment, convective heat losses are minimized, and essentially the only mechanism of heat loss is by the emission of radiation. In accordance with the invention, a fraction of the radiation emitted by the workpiece is absorbed by the reflective envelope and/or by a separate structure disposed inwardly of the reflective envelope and removed from the furnace by a cooling loop or the like as heat. The remainder of the emitted infrared radiation is reflected back to the hot ingot. By controlling the ratio of emitted radiation absorbed to that reflected back to the ingot, a controlled cooling rate can be maintained.

Since no material has perfect reflectivity, the reflective envelope necessarily will absorb a fraction of the radiation which impinges upon it, e.g., 3 to 5 percent. Accordingly, to prevent the reflective surface from overheating, some means must be provided to dissipate this heat. Thus, the envelope can include a cooling loop through which fluid is circulated. Alternatively, it may have a high emissivity surface facing the housing, in which case, as heat builds up in the reflective envelope, radiation is emitted from its back side and can be absorbed and dissipated in the housing (provided with a suitable cooling system).

If the rate of cooling of the particular material to be processed is too slow, a temperature controlled structure having a high emissivity surface, positioned between the workpiece and the reflective surface, can increase the cooling rate. By controlling the temperature of this radiation absorbing structure, the amount of radiation absorbed as heat can be controlled.

If the rate of cooling is too fast, the material may be heated, preferably by direct electrical resistance as a current is passed therethrough via electrical contacts. Since the surface of the material will be cooler than internal regions and thus will have a higher electrical conductance than the core, current passed through the material and the resulting heating will tend to be confined to surface layers. Preferably, relatively high frequency alternating current is passed through the material to take advantage of the well-known skin effect which confines current essentially to the surface of a conductor.

In another important embodiment, the apparatus of the invention is designed for operation as an energy efficient reheating furnance. Like the soaking pit, the furnace comprises a housing which includes a vacuum seal, an envelope having an interior surface of infrared reflective material, a workpiece support located within the envelope, vacuum producing means for evacuating the interior of the housing, and means for heating the workpiece. The heating means preferably comprises an induction reheating coil located within the housing on the exterior of the reflective envelope, but can also be embodied as a pair of electrical contacts for resistance heating. The furnace is operable efficiently to heat a workpiece located on the support in a low pressure environment by eddy current dissipation and/or direct electrical resistance. Infrared radiation emitted from the workpiece is reflected at the infrared reflective surface and directed back toward the workpiece. Because the induction coil is theremally isolated, the use of a cryogenically cooled coil of high conductivity is feasible.

The production of scale and heat loss by convection are overcome because the workpiece is heated in a vacuum, and the furnace has low thermal inertia because it contains no structure in which large amounts of sensible heat are built up. The furnace featuring direct electrical resistance heating is well suited, for example, for heating round billets of varying length.

To protect the reflective surface from the deposition of volatiles which may be present on the surface of the workpiece and from damage caused by spalling, a protective shell can be positioned between the envelope and workpiece. With this arrangement, the vacuum producing means preferably includes a port which communicates with the space between the workpiece and the protective shield so that volatiles are efficiently removed.

Accordingly, objects of the invention include the provision of improved reheating furnaces and soaking pits in which energy consumption is drastically reduced and material loss by scaling essentially is eliminated. Another object of the invention is to provide a uniquely designed reheating furnace which may be adapted for treating very large, e.g., 100 ton, metallic workpieces in preparation for rolling, forging, annealing or other types of hot forming or to treat small workpieces in specialized processing. Another object of the invention is to provide an improved soaking pit wherein the rate of cooling of metallic ingots may be more precisely regulated. Still other objects are to provide an improved process for controllably cooling a workpiece and improved reheating furnaces and soaking pits having low thermal inertia. Yet another object is to provide a reheating furnace capable of employing domestic coal as a fuel (to generate electricity) and capable of utilizing a cryogenically cooled, highly conductive induction coil.

These and other objects and features of the invention will be apparent from the following description of some preferred embodiments and from the drawing in which the dimensions of various elements have been exaggerated to facilitate the description.

BRIEF DESCRIPTION OF THE DRAWING

Like reference characters in the respective drawings indicate corresponding parts.

DESCRIPTION OF THE PREFERRED EMBODIMENT

The advantages of the devices of the invention result from the cooperative interaction of an evacuated chamber in which the workpiece is placed, a highly infrared-reflective envelope surrounding the workpiece, and means for heating the workpiece. In a first embodiment (FIGS. 1 and 2) the apparatus is designed for use as a soaking pit characterized by dramatic decreases in energy consumption as compared with the soaking pits of the prior art and by the elimination of scaling and associated material loss. In a second embodiment (FIG. 3), the apparatus is designed for use as a reheating furnace of low thermal inertia which, like the soaking pit, is characterized by both energy efficiency and the elimination of the scaling problems. Both devices comprise a housing including a vacuum seal, a workpiece support within the housing, a vacuum pump for evacuating the interior of the housing, an infrared reflective envelope including a heat dissipating structure, and means for heating the workpiece. In both devices (but especially the reheating furnace) it will often be impossible to assure that deposits of grease, fats, and the like which may be present on the surface of the workpiece will not be volatilized in the low pressure, high temperature environment and end up as a deposit on the reflective surface of the envelope. Also, spalling at the workpiece surface often ejects fragments of metal oxide which can seriously damage the reflective surfaces. To obviate these problems, where possible, the surface of the workpiece may be cleaned to remove volatiles and all scale (responsible for the spalling) prior to its introduction into the furnace. Alternatively (and preferably), a thin, light-weight shell of high emissivity material such as sheet stainless steel or screen can be placed between the workpiece and the envelope.

The Soaking Pit

Figure 1:
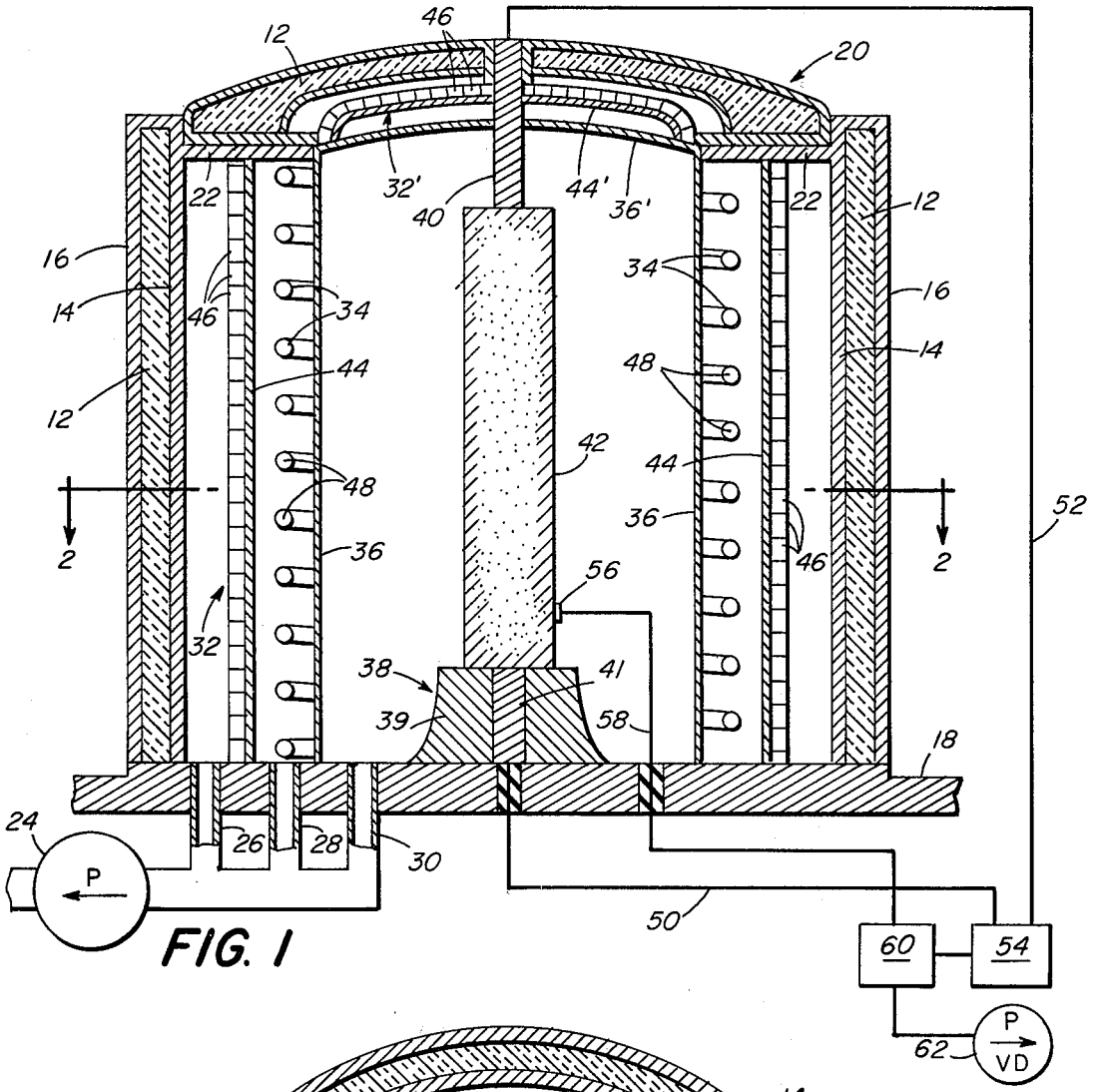
FIG. 1 is a cross-sectional schematic representation of an improved soaking pit constructed in accordance with the invention.
Figure 2:
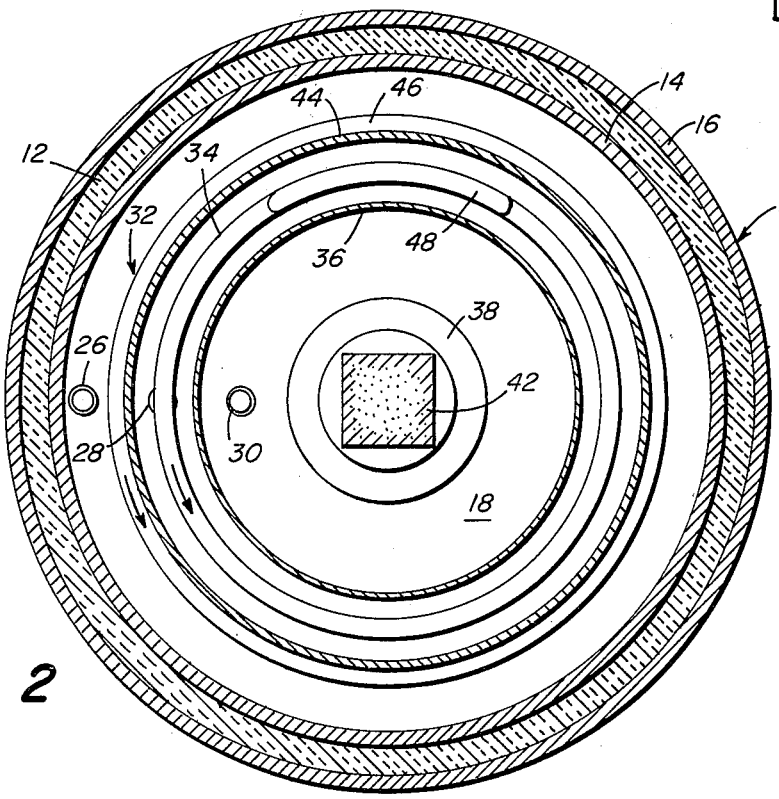
FIG. 2 is a cross-sectional schematic representation of the soaking pit of FIG. 1 taken at line 2—2.

The operation of the improved soaking pit, illustrated in FIGS. 1 and 2, is based upon two principles of physics. The first is that nearly all of the heat transferred away from metals at high temperature (e.g. 2000° F.) is transferred as radiation. The contributions of convection to the surrounding air and conduction through contacts to the total loss of heat is negligible compared with the heat loss by radiation. Thus, as one attempts to effect controlled cooling of a freshly cast steel ingot having a solid outer skin and a liquid or at least very soft interior, the emission of thermal radiation from the surface of the ingot is the mechanism to which one should give the greatest attention.

The second physical principle is that by applying alternating electrical current of sufficiently high frequency (e.g., 100 to 1000 hertz) to a metallic conductor, it is possible substantially to confine the electric current to a thin layer or "skin" at the surface of the conductor. The high frequency current does not flow through the core of the conductor. This means that whatever electrical energy is dissipated in the ingot in question is dissipated essentially in the thin skin that "jackets" the ingot, and heating by electrical dissipation is confined to this jacket. In addition, in most metals of interest, electrical resistivity increases with temperature. Thus, if one were to pass an electric current through a long bar of cooling steel having a surface layer substantially cooler than interior regions, the current would tend to flow in the cooler material near the surface rather than through the interior. This is true irrespective of the frequency of the current. However, by applying current at high frequency it is possible to accentuate the localization of electrical current in the skin of the conductor.

These phenomena are utilized to advantage in the soaking pit depicted in FIGS. 1 and 2. The pit consists of a generally cylindrical housing 10 comprising a layer of insulation 12 sandwiched between inner and outer metal shells 14, 16 mounted on a base 18. A cap 20 engages lip 22 so that a vacuum seal is formed thereby enabling a vacuum in the range of about one mm Hg to be drawn by vacuum pump 24, which communicates via conduits 26, 28, and 30 with the interior of housing 10. The housing of the embodiment shown does not heat up during operation of the soaking pit, and thus it can be made pressure-tight using conventional techniques and sealing materials.

Housing 10 surrounds a series of concentrically arranged components comprising an envelope 32, a radiation absorbing helical coil 34 (optional), and a thin, lightweight shield 36. Cap 20 also features a cooled envelope 32' and shield structure 36'. A workpiece support 38 includes a support structure 39 and a pedestal electrode 41 which, in conjunction with electrode 40, allows the passage of an electric current through a workpiece, here illustrated as steel ingot 42, located on the support.

The envelope 32 comprises an interior highly infrared reflective surface 44 and an exterior corrugated structure having a plurality of passageways 46 through which cooling fluids flow. The cooling structure of envelope 32 should be formed of a heat conductive material not susceptible to thermal shock so that heat generated by incident radiation not reflected by surface 44, i.e., radiation absorbed by the envelope, can be removed by cooling fluid in passageways 46. Copper or copper alloys are preferred materials. It is also possible to employ refractory borosilicate glass or CERVITE, a commercially available lithium aliumina silicate glass. The reflective surface 44 preferably comprises a deposited layer of gold or the like protected by a thin coating of metal oxide or other hard material, which will be infrared-transparent. The preferred reflective coatings comprise highly polished gold, aluminum, or copper layers coated with an oxide of magnesium, aluminum, titanium, or zirconium. The reflective surface should reflect at least about 80% of the infrared radiation it intercepts. However, the preferred metal coatings are characterized by a reflectivity in excess of 95%. The thickness of the protective coating should not exceed about 1000 angstroms in order to avoid undesirable interference effects and to attain a high transmission level in the infrared. Further particulars relevant to suitable reflective coatings for envelope 32 are set forth in U.S. Pat. No. 4,082,414 (Apr. 4, 1978) entitled "Heat Recuperation".

Radiation absorbing structure 34, disposed inwardly of envelope 32, comprises a helical coil of, e.g., copper, having an interior lumen 48 through which cooling fluids are forced by a pump 62. The exterior surfaces of the coil are coated with a radiation absorptive coating (high emissivity coating) such as a metal oxide. Since absorptivity is a function of the temperature of the radiation absorbing body, the amount of radiation absorbed by the coil 34 can be varied by controlling the temperature of the coil which, in this embodiment, may be done by forcing various fluids such as air, water, liquid nitrogen, etc. through the lumen 48. As will be explained below, in many situations the absorption coil 34 may be omitted.

Protective structure 36 comprises a thin, light-weight shell of high emissivity material such as sheet metal or screen of 309 stainless steel or thoria dispersed nickel. The choice of materials involves the normal tradeoffs of engineering design between costs, durability, and reliability. Structure 36 functions to prevent the deposition of volatiles on reflective surface 44 and absorption coil 34 and to prevent other damage to the reflective surface such as might be caused by spalling at the ingot surface. In the embodiment shown, protective structure 36 comprises an integral part of the soaking pit. Alternatively, it can merely be placed about workpiece support 38 and the radiating ingot at the same time that the ingot is introduced into the soaking pit. Further, it will be appreciated that when processing metallic workpieces wherein the likelihood of ejection of volatiles or solid matter is low, protective structure 36 may be omitted.

Electrodes 41 and 40 are provided with alternating electric current through cables 50, 52 from a current source 54. The temperature of ingot 42 is monitored by temperature sensing device 56, e.g., a thermocouple, which communicates via line 58 with a control mechanism 60. The temperature sensing device may also be located on protective structure 36. The control 60 can take a variety of forms. Its function is to actuate current source 54 to induce heating in the ingot or to actuate pump 62 which, through connections not shown, forces fluid through the openings 46 of envelope 32 and the lumen 48 of absorption coil 34 as required. The control 60 can comprise a timed mechanism which periodically compares the sensed surface temperature of the ingot with a predetermined value corresponding to an ideal ingot temperature at various stages of cooling. If the ingot were cooling too rapidly, as indicated by a sensed temperature lower than the selected temperature, the absorptivity of absorption coil 34 and/or envelope 32 would be decreased to retard cooling, or current source 54 could be actuated to increase the surface temperature of the ingot. If, on the other hand, cooling is proceeding too slowly, controller 60 would actuate pump 62 to lower the temperature and thus the emissivity of adsorption coil 34 and/or envelope 32 so as to increase the fraction of emitted radiation absorbed.

In operation, an ingot is stripped of its mold and loaded into the soaking pit on pedestal electrode 38. After cap 20 is seated on lip 22 and electrode 40 is in contact with the ingot, vacuum pump 24 is actuated to remove the air and other gases from the interior of the chamber so that the pressure is below about 1 mm Hg. This step accomplishes two things. First, it eliminates the oxygen and other gases that react to form surface scale on the ingot and result in loss of product, and second, it eliminates convective heat transfer from the ingot. Accordingly, essentially the only way heat can escape from the ingot is by radiation and by a negligible flux of conduction through support 39 and electrodes 40 and 41. Support structure 39 should be formed from a high temperature alloy (e.g., 309 stainless steel); electrodes 40 and 41 should be formed of a material of low resistivity. It may be necessary to provide the electrodes with water cooled jackets (not shown) in order to balance the electrical dissipation that may be required in the ingot.

The hot ingot will emit infrared and other radiation to the protective shield 36. The shield, in turn, heats up and emits radiation. Some of the radiation is returned to the ingot; the remainder is radiated to the reflective envelope 32. Because the shield structure 36 is thin, it acts as a muffle and can be considered to be in thermal equilibrium with the surface of the ingot. (For this reason temperature sensor 56 may be located on shield 36.) Thus, when the reflective coating reflects thermal radiation back to the shield 36, the effect is as if the heat had been reflected back to the ingot itself. The net effect of the reflection of heat from the reflected envelope is accordingly to prevent the heat from escaping from the ingot.

Of course, the reflective envelope cannot reflect radiation with 100% efficiency. Thus, some slow cooling of the ingot will occur, and this is exactly what is desired. Radiation absorbed by a reflective envelope 32 will be dissipated as heat and removed via the cooling fluids passing through the openings 46 in the cooling structure. This, in and of itself, will result in the ingot slowly becoming cooler. If, as illustrated in the drawing, a separate radiation absorbing structure 34 is included in the apparatus, this too will absorb radiation, the amount of radiation absorbed being controlled by the temperature of structure 34.

The net flux of radiant heat q between a body at absolute temperature $T_1$, with emissivity $E_1$, and an environment that surrounds the body of temperature $T_2$ and emissivity $E_2$ is given by formula:

$$q = \frac{\sigma (T_1^4 - T_2^4)}{\frac{1}{E_1} + \frac{1}{E_2} - 1}$$

where $\sigma$ equals the Stephan-Boltzman constant, $0.1713 \times 10^{-8}$ BTU/ft$^2$.°F.$^4$. If, as an example, the ingot were at 2860° R. absolute ($T_1$) and had an emissivity of 0.95, and the reflective envelope 32 had an emissivity of 0.05 (gold coatings can provide 0.03 to 0.02 emissivity), and a temperature of 560° R. absolute ($T_2$), the rate of heat loss from each square foot of surface of the ingot would be approximately 5318 BTU/hr. At this initial rate of cooling, it would require approximately 1300 hours for a 2 ft.×2 ft.×8 ft. ingot to cool from a temperature at which it is removed from the mold to room temperature. Of course, this estimate is not fully meaningful since, as the surface of the temperature of the ingot falls, the rate of emission of radiation and thus the rate of cooling also falls. However, this example illustrates that the reflective enclosure can provide an environment in which very slow cooling of the ingot can be obtained without the expenditure of any fuel whatever. The heat flux loss from the ingot (5318 BTU/hr./ft.$^2$ of ingot surface) must be absorbed by the reflective envelope 32 and absorption coil 34 (if one is used). This heat flux would soon heat the reflective envelope to a very high temperature if some means were not provided to dissipate heat. Since the chamber is evacuated to eliminate oxidation of the ingot, it is not possible to rely upon convection to dispose of any of this heat flux.

Thus, the reflective envelope itself is cooled directly by a fluid circulating loop illustrated at 46. Fluid such as water (treated as for boiler use to eliminate minerals etc.) is pumped through the loop to carry away the heat absorbed by the reflector. Alternatively, it is possible to coat the back of the reflective envelope with a material of high emissivity so that it radiates to the housing 10. The housing should then be equipped with cooling loops (not shown).

Of these two possibilities for disposing of the heat absorbed by the reflective envelope, it is preferred to provide a cooling loop in direct thermal communication with the reflective envelope. This approach offers the advantage of keeping the housing 10 from heating up. Since the housing must support the load of the atmosphere while the chamber is evacuated, it is preferable to prevent the housing from becoming very hot. However, this objective could also be accomplished through the use of a cooling loop in the housing.

In a situation where the ingot cooling rate is top slow, additional cooling fluid can be pumped through the openings 46 of reflective envelope 32. If further increases in the heat loss are required, a fluid such as air, argon, water, etc. is circulated through absorption structure 34 so that more radiation is absorbed and the net radiative flux from the ingot 42 is increased.

It is contemplated that a device embodying the invention would normally be operated repeatedly to cool multiple similar ingots. Accordingly, such a device would be designed to effect a selected cooling rate, and straightforward engineering would allow a determination in advance of construction of the device as to whether an absorption coil would be required. However, if the device were designed to treat various different workpieces, then the inclusion of an absorption coil would allow an additional degree of flexibility in cooling rate.

If the ingot cools too rapidly, a high frequency electric current is passed through the skin of the ingot to electrodes 41 and 40. This prevents heat loss from within the ingot. It can, in fact, replace the heat normally radiated by the surface of the ingot by means of the electrical dissipation that will occur in the skin of the ingot. By monitoring the temperature of the ingot, it is possible to adjust the current flow and the cooling flow through the absorption structure and/or envelope to control the ingot cooling rate to essentially any level desired.

The amount of energy required by the soaking pit is very small as compared with the currently employed devices. For example, in the case described above, an ingot 2 ft.×2 ft.×8 ft. could be held at its original temperature indefinitely with an electrical input of only approximately 112 kilowatts. This is less than the power normally required to run the combustion air fans of a small conventional soaking pit. Further, it is apparent that the soaking pit of the invention also offers advantages of control of pollution, worker safety, maintenance and general cleanliness and orderliness of operation in a metal casting shop.

Reheating Furnace

As noted above, reheating furnaces are used to raise the temperature of metallic shapes prior to subjecting them to rolling, forging, annealing, or other hot forming process. In accordance with the invention, reheating can be done in a furnace which, like the soaking pit disclosed above, features an evacuated enclosure containing a central workpiece support, one or more heating devices, and a cooled, infrared reflective envelope. Optionally, it also includes a protective shell located to protect the reflective envelope. With this arrangement, the workpiece may be rapidly heated, e.g., by electrical resistance and/or by dissipation of eddy currents induced in the workpiece by an induction coil located in the space between the housing and the reflective envelope. Because the workpiece is in an evacuated environment, the surface reactions which result in the production of scale and in material loss in conventional furnaces do not occur, and convective heat losses from the workpiece are eliminated. As the workpiece increases in temperature, it gives off increasing amounts of infrared radiation, which, because of the reflective envelope, is in the main returned to the workpiece. Further, the furnace may be turned on and off quickly, i.e., is characterized by low thermal inertia, since it contains no structure in which large quantities of heat are stored.

Figure 3:
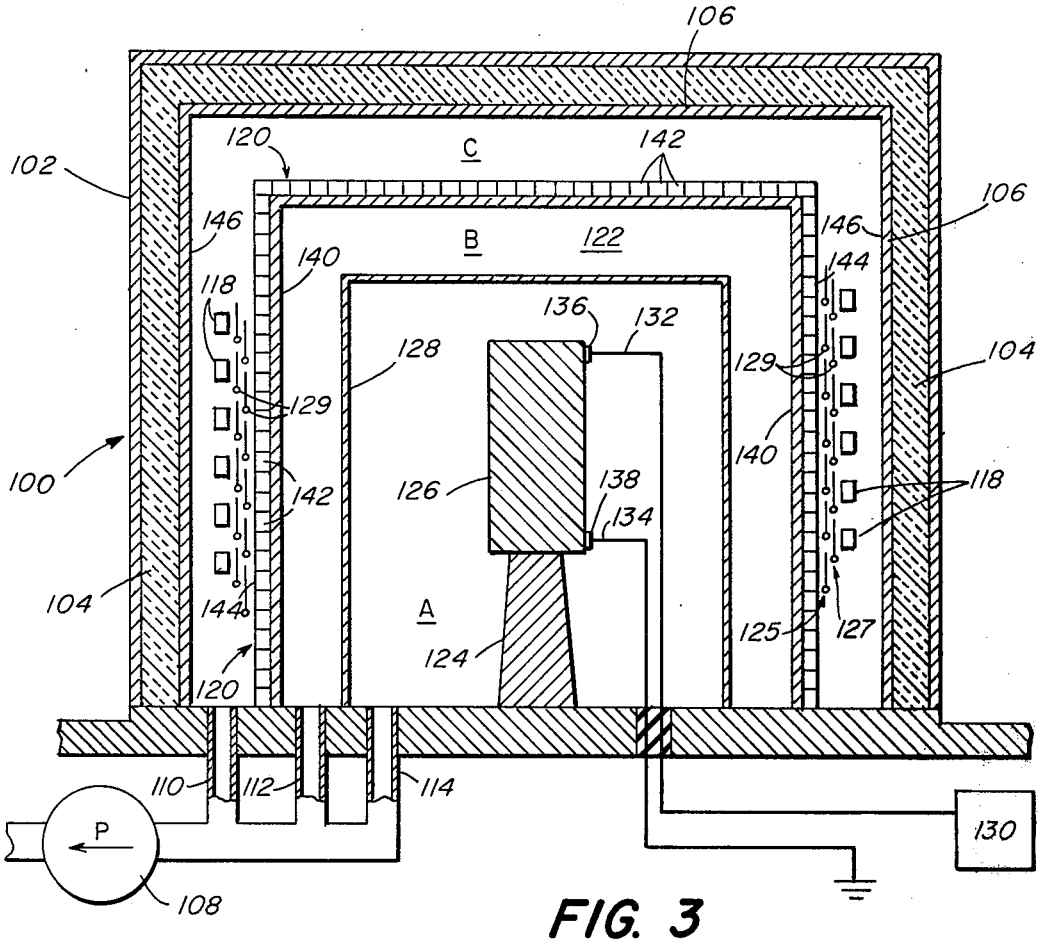
FIG. 3 is a cross-sectional schematic representation of a reheating furnace embodying the invention.

Referring to FIG. 3, an embodiment of the furnace of the invention is shown. It comprises a housing 100 having an outer metallic shell 102, a layer of insulation 104, and an upper shell 106. The housing forms a vacuum seal so that a vacuum in the range of about 1 mm Hg can be drawn by a vacuum pump 108, which communicates via conduits 110, 112 and 114 with the interior of housing 100.

Housing 100 surrounds a series of concentrically arranged components comprising an induction coil 118, baffle layers 125, 127, and a cooled envelope 120. The envelope 120 defines an enclosed chamber 122 which contains a workpiece support structure 124 in supporting relation to a workpiece 126, illustrated as a steel billet, and a protective shield 128 positioned between workpiece 126 and envelope 120. Electric current from a current source 130 may be passed directly through the billet 126 through electric leads 132, 134 and contacts 136, 138.

The envelope 120 comprises an interior highly infrared reflective surface 140 and an exterior corrugated structure having a plurality of passageways 142 through which cooling fluids flow. The envelope's cooling structure is formed of a heat conductive material such as copper so that heat produced by radiation not reflected by surface 140 (i.e., radiation absorbed by the envelope) can be rapidly removed by cooling fluid in passageways 142. The reflective layer 140 is constructed in accordance with the disclosure set forth above.

Prior to introducing the workpiece into the furnace, the workpiece may be dipped or scrubbed with a solvent to remove oils or other volatile materials which could be evaporated in the reheating process and later deposited on the reflective surface 140 of envelope 120. Further, if the workpiece can be well cleaned (for example by wire brushing) to remove all scale prior to the reheating process, the spalling problem might well be obviated. However, either or both of the foregoing steps may be eliminated if the lightweight shield shown at 128 is interposed between the workpiece 126 and the envelope 120. There is no requirement that the shield 128 be an integral part of the furnace. Rather, it can simply be placed over the workpiece prior to its introduction into the furnace. If only volatiles have been removed from the workpiece prior to its introduction, to protect the reflective surface 140 of the envelope 120 from the effects of spalling, shield 128 need consist only of a stainless steel screen material. If, on the other hand, the deposition of volatiles onto reflective surface is a possibility, then shield 128 should be made of thin sheet metal or ceramic stock that is permeable to magnetic fields and constructed of the materials discussed above.

In the illustrated embodiment, the workpiece can be heated either by resistance as electric current is passed therethrough or by the induction coil 118 which is energized with alternating current to heat the workpiece by eddy current dissipation. If an induction coil is used, all structure between it and the workpiece should be transparent to the magnetic field generated by the coil. Thus, the frequency of the current used and the thickness of the structures between the coil and the workpiece should be matched so that substantially no induction heating occurs in the envelope, etc.

In accordance with an important aspect of the invention, the induction coil 118 may be constructed in accordance with developed cryogenic technology so that the conductor forming the coil is maintained at a temperature at which the particular metal is highly conductive or behaves as a superconductor. Applying cryogenic technology to magnetic induction coil heaters has not been practical heretofore because of the difficulty of thermally isolating the coil in a conventional furnace such that maintenance of cryogenic temperatures is feasible. However, because of the envelope of the furnace of the instant invention, on the order of 97% or more of the infrared radiation emitted by the workpiece is returned thereto, and because of the evacuated environment, no heat is transmitted to the induction coil by convection. Whether a superconducting coil is employed and is cost effective, as compared to a coil cooled to a lesser degree but exhibiting a reduced resistivity, will vary with circumstances.

Figure 4:
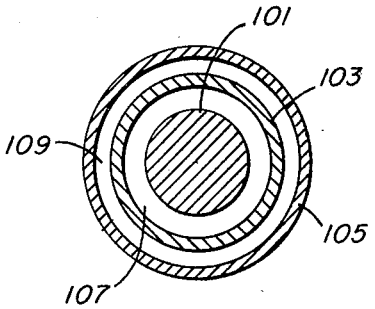
FIG. 4 is a cross-sectional view of a cryogenically cooled induction coil suitable for use in the furnace of FIG. 3.

In embodiments wherein a cryogenic type induction coil is used, as shown in FIG. 4, the coil can comprise an interior metallic conductor 101 surrounded by concentric conduits 103, 105 defining flow paths 107, 109 containing, respectively, liquid helium or the like and liquid nitrogen. The exterior of the coil is preferably highly reflective so that absorption of stray infrared radiation is avoided. To protect the coil from stray infrared radiation which may be emitted from the exterior surface of the envelope 120, the exterior surface 144 of envelope 120 is coated with a low emissivity material to minimize the emission of radiation, and two or more overlapping, concentrically positioned, liquid nitrogen-cooled baffle layers 125, 127 may be interposed between the coil 118 and envelope 120. The surface of the individual baffles that faces toward the envelope is coated with a high emissivity material such as a metal oxide so that any radiation impinging on the surface is absorbed as heat; the surfaces of the baffles facing the coil should have a low emissivity. Any heat absorbed by the baffles is then removed by fluid coolant passing through conduits 129 formed integrally with each baffle. Also, it may be advantageous to coat the inner surface 146 of housing layer 106 with a low emissivity material so that thermal radiation from this source is minimized. Because of these design features, the coil does not experience the temperature increases characteristic of conventional induction coil reheating devices, the normally encountered problems of increased coil resistivity are avoided, and the use of a cryogenically cooled coils becomes feasible.

In operation, the workpiece is introduced into the space A (defined by shield 128) through an access door (not shown). The housing is then sealed, and pump 108 is actuated to draw a vacuum. The pressure within the housing should be less than about 1 mm Hg. Power source 130 is then energized to initiate heating of the workpiece 126, or the induction coil 118 is energized. Since the induction coil is either of very low resistance or is superconducting, and since all structures between the induction coil and workpiece 126 are magnetic field transparent, the workpiece 126 essentially becomes the only source of heat in the furnace. (Electrical engineering design has already been applied to induction furnaces to reduce dissipation of energy in materials outside the furnace cavity through leakage in the induction field.) Thus, the most important step in controlling losses of heat from the furnace is to keep heat from escaping the workpiece itself. Heat loss by conduction through support structure 124 can be minimized by conventional engineering techniques. Convective losses are eliminated by the presence of the vacuum within the furnace. Thus, heat loss from the workpiece will be essentially limited to the emission of infrared radiation.

The infrared radiation emitted into space A by the workpiece first encounters shield 128 (if one is used), which reflects a small portion of the incident radiaton and absorbs and re-emits the rest. Such re-emission is both back toward workpiece 126 and outward toward the reflective surface 140. Since reflective coatings having a reflectivity greater than 0.97 in the infrared region of the spectrum are currently avilable, even if the reflective envelope 120 were at absolute zero the heat loss from the workpiece 126 would be reduced to approximately 3% of the black-body radiant flux associated with the temperature (e.g. 2400° F.) of the workpiece. In practice, it is immaterial whether the radiant heat reflected by the interior surface of the envelope is returned directly to the workpiece or to the lightweight shield about the workpiece. If the shield is present, it functions as a muffle and rapidly reaches thermal equilibrium with the workpiece.

The foregoing discussion assumes that each ray reflected from the envelope returns directly to the workpiece 126 (or shield 128). This assumption will hold providing the distance between the workpiece and the reflective envelope is small compared with the dimensions of the workpiece. If multiple reflections are necessary before the radiation is directed back to its original source, the effective reflectivity of surface 140 will be slightly reduced.

In view of the above, and even though reflective coatings having a reflectivity in excess of 0.99 are currently being developed, it is apparent that a certain amount of heat transferred from the workpiece as infrared radiation will be absorbed into the structure of the envelope 120. Thus, cooling fluid such as liquid nitrogen is passed through passageways 142, thereby removing heat as it is absorbed into the substrate of the envelope.

The foregoing discussion of the system's operation can be summarized by analyzing the radiation effects in spaces A, B, and C. This will define all heat transfer operations, since, as noted above, conduction and convection within the furnace essentially are eliminated.

In space A, the stock radiates to the shield 128 (muffle). The shield both reflects and absorbs and reradiates to the stock. The most important mechanism here is the latter: absorption and reradiation. The shield will exhibit some small reflectivity (0.02, usually). In space B, the shield radiates to the envelope 120, which reflects radiation back to the shield and absorbs a small fraction as heat. In space C, despite the low emissivity surface 144, the envelope will radiate from its outside surface to the coils 118 (if employed) and the housing 100. As noted previously, the coil and housing surfaces should be as highly reflective as possible and heat absorbed on the coil should be removed by cooling fluids, especially if the cryogenic technology is employed.

The foregoing system can be maintained at a low vacuum quite easily. Since little or no heat reaches the housing from the interior of the furnace, the vacuum seal can be maintained with the use of commercially available polymeric films which maintain their integrity even at temperatures as high as 600° F.

Of course, it is within the scope of the invention to employ an induction coil without direct electrical resistance heating and to employ resistance heating without an induction coil. In certain situations, the furnace of this invention featuring direct electrical resistance heating is preferred over the furnace which features only a magnetic induction coil. For example, if billets of varying length are to be heated, it may be easier and less expensive to couple electric energy to the stock via direct passage of current through the stock than to couple the induction field through the envelope, etc. This is because induction coils generally must be designed to handle only one length of stock.

Other embodiments are within the following claims.

What is claimed is:

1. An energy efficient apparatus for varying the temperature of a metallic workpiece, said apparatus comprising:

a housing including a vacuum seal, a workpiece support within the housing, means for evacuating the interior of the housing, an infrared reflective envelope within the housing disposed to reflect radiation emitted from a hot workpiece on said support back to the workpiece, said envelope comprising an infrared reflective surface and means for dissipating heat, and means for heating a workpiece located on said workpiece support.

2. The apparatus of claim 1 further comprising a shield having high emissivity surfaces disposed to protect the reflective envelope from matter ejected by a workpiece on said support.

3. The apparatus of claim 2 wherein said means for evacuating the housing includes a port which communicates with the space between the workpiece and the shield.

4. The apparatus of claim 1 useful as an improved soaking pit wherein said means for dissipating heat comprises a cooling fluid circulating loop in thermal communication with said envelope, whereby a hot, radiating ingot placed on said support may be cooled at a controlled rate as a fraction of the radiation emitted therefrom is absorbed into said envelope.

5. The apparatus of claim 1 useful as an improved soaking pit, said apparatus further comprising means separate from said envelope for absorbing a fraction of the radiation emitted by a workpiece, said absorbing means comprising a fluid cooled body having a high emissivity surface located inwardly of said envelope.

6. The apparatus of claim 1 useful as an improved soaking pit wherein said means for dissipating heat comprises a high emissivity surface on the side of said envelope opposite said infrared reflective surface.

7. The apparatus of claim 1 useful as an improved soaking pit wherein said means for heating comprises means for passing alternating current through a surface layer of said workpiece.

8. The apparatus of claim 1 useful as an energy efficient furnace for heating a workpiece wherein the housing is separated from the envelope, the envelope is made of magnetic field permeable material, and said heating means comprises a magnetic induction coil within said housing and surrounding said envelope and means for passing an electric current through said workpiece, said furnace being operable to heat a workpiece located on said support by magnetic induction or electrical resistance and to reflect radiation emitted from the workpiece at the reflective surface of said envelope back to the workpiece.

9. An improved soaking pit for cooling a hot, radiating metallic ingot or the like at a controlled rate, said soaking pit comprising:

a housing including a vacuum seal;

means for evacuating the interior of the housing;

an ingot support within the housing;

means for absorbing radiation emitted from an ingot on said support and for reflecting radiation back thereto; and means for controlling the fraction of radiation absorbed by said absorbing means so that the net radiative energy loss from said ingot can be controlled to result in a selected cooling rate.

10. The soaking pit of claim 9 wherein said control means comprises:

means for passing an electric current through an ingot located on said support;

means for passing cooling fluids through said radiation absorbing means to control its emissivity; and means for monitoring the temperature of said ingot.

11. The soaking pit of claim 9 wherein said radiation absorbing means comprises a fluid cooled structure having a high emissivity surface disposed inwardly of said radiation reflecting means.

12. The soaking pit of claim 9 further comprising means for passing an electric current through an ingot located on said support.

13. The soaking pit of claim 12 wherein said means for passing an electric current comprises means for passing high frequency alternating current so that resistive heating of the ingot is confined essentially to a surface layer thereof.

14. The soaking pit of claim 9 wherein said means for absorbing radiation emitted from the ingot on said support and for reflecting radiation back thereto comprises an infrared reflective envelope having integral means for dissipating heat.

15. An energy efficient furnace for heating metallic workpieces, said furnace comprising:

an envelope of magnetic field permeable material defining a chamber, said envelope having an interior infrared reflective surface and cooling means for removing heat therefrom;

a workpiece support located in said chamber;

vacuum producing means for evacuating said chamber;

a magnetic induction coil surrounding said envelope; and a housing about the induction coil, said furnace being operable to heat a workpiece located on said support in a low pressure environment and to reflect infrared radiation emitted from the workpiece at the interior surface of said envelope back to said workpiece.

16. The surface of claim 15 wherein said housing includes a vacuum seal and the vacuum producing means is operable to evacuate the space on both sides of the envelope.

17. The furnace of claim 15 further comprising a magnetic field permeable protective shield spaced inwardly from said envelope for protecting the interior infrared reflective surface.

18. The furnace of claim 15 wherein said induction coil is cooled.

19. The furnace of claim 18 wherein said induction coil is cooled to a temperature at which the coil behaves as a superconductor.

20. The furnace of claim 18 wherein the interior surface of the housing and the exterior surface of the envelope comprise low emissivity material.

21. The furnace of claim 18 wherein cooled, magnetic field permeable, radiative baffles are interposed between the induction coil and the envelope.

22. The furnace of claim 15 wherein the envelope cooling means comprises a heat conductive substrate defining a plurality of passageways for channeling cooling fluid.

23. A process for cooling a hot, radiating metallic ingot or the like at a controlled rate comprising the steps of:

placing the ingot in an enclosure;

evacuating the enclosure to minimize convective heat losses and to minimize ingot surface chemical reactions;

reflecting radiation emitted by the ingot back thereto, and controlling the amount of emitted radiation which is reflected back to the ingot by absorbing a fraction of the emitted radiation as heat so that the net ingot radiative loss results in cooling at a controlled rate.

24. The process of claim 23 wherein the reflecting step is effected by providing an infrared reflective envelope about the ingot and wherein said envelope absorbs a fractions of the emitted radiation in excess of the amount required to result in a selected cooling rate, said process comprising the additional step of heating a surface layer of the ingot to decrease the net heat loss.

25. The process of claim 24 wherein the heating step is effected by passing an electric current through the ingot.

26. The process of claim 25 wherein the electric current employed is a high frequency alternating current whereby resistance heating in the ingot is confined essentially to a surface layer thereof.

27. The process of claim 23 wherein the amount of radiation reflected back to the ingot is diminished by absorbing a portion of the emitted radiation into a temperature controlled structure.

28. The process of claim 27 wherein the temperature controlled structure comprises a fluid-cooled, infrared reflective envelope about the ingot.

29. The process of claim 27 wherein the temperature controlled structure comprises a fluid cooled body having a high emissivity surface.

30. The process of claim 23 comprising the further step of providing a thin layer of protective material of high emissivity about the ingot.

31. A process for cooling a hot, radiating metallic ingot or the like at a selected rate, said process comprising the steps of:

placing the ingot in an enclosure, evacuating the enclosure to minimize heat losses by convection and to minimize ingot surface chemical reactions, providing means for reflecting a selected portion of the radiation emitted from the ingot back to the ingot and means for passing an electric current through the ingot; and controlling the net rate of emission of radiation from the ingot by adjusting the amount of radiation reflected back thereto and the magnitude of the current passed therethrough during cooling to result in a selected ingot cooling rate.

32. The process of claim 31 wherein the current is adjusted to zero.

33. The process of claim 31 wherein the current is alternating current of a frequency suitable to confine current flow and resulting resistance heating substantially to a surface layer of the ingot.

34. The process of claim 31 wherein said means for reflecting a selected portion of the emitted radiation comprises an infrared reflective envelope having a reflectivity no less than 80% and a temperature controlled mass into which radiation is absorbed as heat.

35. A process for heating an electrically conductive workpiece comprising the steps of:

A. treating the surface of the workpiece to remove volatile materials;

B. placing the workpiece in an enclosure having an interior infrared reflective surface;

C. evacuating the enclosure;

D. heating the workpiece to induce the emission of infrared radiation therefrom; and E. allowing the radiation to be reflected at the interior surface and directed back to the workpiece.

36. The process of claim 35 wherein the workpiece is heated by magnetic induction using a magnetic induction coil located outside said enclosure.

37. The process of claim 35 wherein the workpiece is heated by direct electrical resistance.

38. A process for heating an electrically conductive workpiece comprising the step of:

A. placing the workpiece in an enclosure having an interior infrared reflective surface;

B. interposing a layer of protective material between the workpiece and the interior surface;

C. evacuating the enclosure;

D. heating the workpiece to induce the emission of infrared radiation therefrom;

E. allowing the workpiece and the layer to attain thermal equilibrium by radiative transfer; and F. allowing radiation to be reflected at the interior surface and directed back toward the workpiece.

39. The process of claim 38 wherein the layer comprises screen material so that matter ejected from the surface of the workpiece via spalling is intercepted thereby and a portion of the radiation emitted by said workpiece passes therethrough.

40. The process of claim 38 wherein the layer comprises a metal foil.

41. The process of claim 38 wherein the workpiece is heated by magnetic induction using a magnetic induction coil located outside said enclosure.

42. The process of claim 38 wherein the workpiece is heated by direct electrical resistance.

* * * * *